United States Patent [19]

DeCormier et al.

[11] Patent Number: 4,951,013

[45] Date of Patent: Aug. 21, 1990

[54] PHASE SHIFT CONTROLLED BROADCAST SWITCHING SYSTEM

[75] Inventors: William A. DeCormier, West Poland; David B. Folsom, Bridgton, both of Me.; Philip C. Noll, Pennsauken, N.J.

[73] Assignee: General Signal Corporation

[21] Appl. No.: 202,771

[22] Filed: Jun. 3, 1988

[51] Int. Cl.[5] ..... H01P 5/16

[52] U.S. Cl. ..... 333/117; 333/156

[58] Field of Search ..... 333/109, 117, 121, 156

[56] References Cited

U.S. PATENT DOCUMENTS

| | | | |
|---|---|---|---|
| 3,582,790 | 6/1971 | Curtis | 333/117 X |
| 3,768,045 | 10/1973 | Chung | 333/109 X |
| 4,153,994 | 5/1979 | Ren | 333/121 X |
| 4,232,399 | 11/1980 | Heiter | 333/101 X |
| 4,383,189 | 5/1983 | D'Oro | 333/117 X |
| 4,602,227 | 7/1986 | Clark et al. | 333/101 X |
| 4,721,959 | 1/1988 | Syrigos | 333/117 X |

*Primary Examiner*—Eugene R. LaRoche
*Assistant Examiner*—Benny Lee
*Attorney, Agent, or Firm*—Robert R. Hubbard; John F. Ohlandt

[57] ABSTRACT

A broadcast switching system includes at least two sources, such as power amplifiers or transmitters; a waste or dummy load; and an antenna. A non-contacting switching arrangement for such a system includes directional or hybrid couplers for suitably cross-coupling portions of the signals from each of the sources. The present system is such that at least two couplers of nominally identical value may be employed regardless of input power ratios and yet, required power levels can be obtained at the outputs by reason of the deployment of phase shifters providing controlled phase delays over the entire range, which phase delays are precisely selectable for a full range of input power ratios. Although a nominal coupling value of −3 dB for the couplers may be utilized, the invention is not necessarily restricted to this value.

11 Claims, 5 Drawing Sheets

| POWER | | PHASE | | POWER | |
|---|---|---|---|---|---|
| A | B | C | D | OUTPUT | WASTE LOAD |
| 100 | 100 | 0 | 0 | 200 A & B | 0 |
| 100 | 100 | 0 | -180 | 0 | 200 A & B |
| 100 | 100 | -180 | 0 | 0 | 200 A & B |
| 100 | 0 | - 90 | 0 | 100 A | 0 |
| 100 | 0 | 0 | -90 | 0 | 100 A |
| 0 | 100 | 0 | -90 | 100 B | 0 |
| 0 | 100 | - 90 | 0 | 0 | 100 B |

PHASE SHIFT CONTROLLED BROADCAST SWITCHING SYSTEM

FIELD OF THE INVENTION

This invention relates to broadcast transmitters and especially to television, or visual, broadcasting; it particularly pertains to noncontact switching arrangements for switching a plurality of high-power, high-frequency signal sources or transmitters to a plurality of loads such as to a dummy or waste load or to an antenna or the like.

BACKGROUND OF THE INVENTION

As will be appreciated from reference to U.S. Pats. No. 4,602,227 and 4,723,307, it is very desirable, particularly in television broadcasting, that the broadcaster be able to readily choose to couple the maximum possible television signal power to the antenna and to keep the broadcasting station operating under all conditions. One preferred way of doing this is to use two transmitters or high-power amplifiers in parallel and to couple the power therefrom to the antenna. Thus the advantage of improved reliability is obtained in that operation at reduced power continues if one of the transmitters fails. There is the further advantage that a given output power can be achieved by the use of a plurality of inexpensive low-power output stages rather than by means of a single expensive high-power unit.

So-called switchless switching arrangements have been developed in order to allow switching of a transmitter output while energized, and this usually takes the form of phase shift controller switching. Generally speaking, an arrangement for such non-contact switching includes a directional or hybrid coupler for combining the outputs of two transmitters and for coupling them by way of two legs or paths to a further hybrid coupler having one of its outputs coupled to the antenna and another coupled to a dummy or waste load. Each of the two legs or paths includes a controllable phase shifter. Such an arrangement allows both transmitters to be operated simultaneously, and allows the signals to be switched between the antenna and the waste load without the switching of contacts and without de-energizing the transmitters. Instead, the switching is often accomplished by selective control of the reactive terminations associated with the circuit. Control of these reactances causes the signals arriving at the antenna or at the waste load by the two paths to be either in-phase and therefore add, or to be out of phase and therefore cancel. One form of controllable phase shifter involves a coaxial variable conductance-capacitance circuit, such circuit including a series coaxial capacitance formed by a hollow inner conductor having a gap which is centered in a coaxial inner conductor. An insulated conductor slug is located within the hollow center conductor and is movable between a position straddling the gap and a position remote from the gap by varying the capacitance across the gap. A series inductance trims the capacitance. This arrangement of the controllable phase shifter is advantageous, as may be appreciated by reference to the aforenoted U.S. Pat. No. 4,723,307.

However, the approach taken to non-contact switching of signals in that patent seeks to avoid some of the disadvantages associated with the earlier known coaxial variable inductance-capacitance scheme; which scheme does present certain packaging problems because four hybrid or directional couplers and two independently actuated sets of reactive terminations are required, each set including a pair of simultaneously actuated coaxial inductance-capacitance circuits.

Accordingly, in order to overcome these drawbacks the approach in U.S. Pat. No. 4,723,307 is to provide non-contact switching among sources and loads by a simplified apparatus as described therein. However, this approach has certain limitations of its own when it comes to variability of input power ratios, that is, differences in the two power levels involved in the first and second sources or transmitters. In the switching systems described in U.S. Pat. No. 4,723,307 the phase shifters are limited to selecting three possible phases such as 0, −90, and −180 degrees. This is fine in those situations where the power from the A and B sources are equal, let us say, each having a value of 100 kilowatts, or where one of the sources has a value of 100 and the other a value of 0.

Specific reference to FIG. 1 herein illustrates such a switching system as is described in U.S. Pat. No. 4,723,307. It will be noted that two sources, A, B, each at zero degrees, are fed to a first, −3dB, 90 degree hybrid coupler 10, are combined therein and the combinations are sent by separate output ports 12 and 14 to phase shifters C and D in the respective coaxial paths or legs. A further hybrid coupler 16, shown in the specific form of a Magic Tee, is provided with both a normal or main output and a waste load output as indicated.

As will be understood by those skilled in the art, the first coupler, that is, coupler 10, produces at one of its output ports, for example port 12, the sum of the first signal, or signal A, plus a relatively phase-shifted (90 degrees) second signal, or signal B; whereas at the second output port, i.e., port 14, the opposite of the first situation obtains; that is, the sum of the second signal plus a relatively phase-shifted first signal. Likewise, for the second coupler in the form of a Magic Tee 16. The effects of the phase shifting arrangement, in the form of phase shifters C and D in each of the respective legs 18 and 20, will be apparent from the table appearing. immediately below the diagram in FIG. 1.

In the past, if one wanted to build a switchless RF switcher in either coaxial construction or in wave guide, the coupler was used with a coupling value equal to the ratio of the lowest input power compared to the combined output power. Thus, two equal inputs produce an output equal to twice either of the inputs. Accordingly, a −3 dB coupler would be employed. However, if one wanted to combine two inputs of unequal power, for example, where one input level is equal to half of the other input level, the ratio of the lowest input to the output is then 1:3 or −4.77dB.

In each of the above cases, that is in either the −3dB coupler case or the −4.77dB coupler case, the output of the combination could be maintained to approach 100% of total input by proper phasing of delay lines to a second coupler which is adjusted to −3dB. Reference to FIG. 1 will make this quite clear; that is, the use of couplers and phase delays to achieve 100% combining. In the illustrated case in FIG. 1, the phase control provides the ability to combine both transmitters or sources A or B individually (where, for example, both have an input power level of 100) into the normal output or the waste load for test purposes. The phase control, of course, also provides the ability to feed either transmitter into either the normal output or the waste load when the other transmitter output power level is 0.

However, a serious problem is presented when the two inputs are unequal in their primary design mode of operation such as, for example, if the A input has a value of 100 and the B a value of 50.

Accordingly, it is a primary object of the present invention to overcome the difficulties presented in a broadcast non-contact switching system when the two input power levels are unequal such that one cannot efficiently obtain appropriate output power levels.

Another object is to obtain efficiencies in excess of 99% with any input power ratio.

A further object is to enable the combining of three sources or transmitters by means of noncontact switching so as to achieve minimum losses.

SUMMARY OF THE INVENTION

The essentially novel feature of the present invention is a unique arrangement which permits the use of at least two couplers of nominally identical value regardless of input power ratios. The coupling value can be selected to be the normal −3dB value; however, it is not limited to such coupling value. The desired efficiencies are attained by reason of the provision of phase shifters suitably controllable to select specific phase delays in accordance with the given input power ratios, whereby the sum of the unequal input power levels can be obtained at the outputs. Thus, delays are other than the conventional delays of 0, −90, −180, −55, and −125 degrees which have been selectable heretofore; for example, those selected for the phase shifters or phase shifting means C and D seen in FIG. 1. Instead, phase delays are provided over a full range of input power ratios from 100:100 to 100:0.

As will be explained in detail hereinafter, the effective phase delay for the first, or bottom leg, phase shifter is selected to vary from 0 to −90 degrees as the input power at the A source varies, whereby the sum of A and B power levels appears at the normal output. To achieve the opposite result, that is, to have the sum of A and B appear at the waste load output, then that first phase shifter is assigned a delay 180 degrees greater than the listed value in the tabulation.

On the other hand, if the input power at the B source is varied while the input power at the A source is held constant, (opposite to what is listed in Table I), then the second, or top leg, phase shifter must be assigned the greater phase shift to produce the same desired efficiencies.

It will be appreciated as the description proceeds that the principle of the present invention can be extended to a typical 180 kilowatt visual and aural diplexer system so as to enable the user to operate with one of his 60 kilowatt transmitters (60 kilowatts being a conventional power level), or with any combination of two transmitters or all three transmitters. As will be made evident, the user can also switch between each of these modes of operation while remaining in an operating condition with no loss of signal to his listening audience.

Other and further objects, advantages and features of the present invention will be understood by reference to the following specification in conjunction with the annexed drawing, wherein like parts have been given like numbers.

DESCRIPTION OF THE PREFERRED EMBODIMENT

Figure 1:
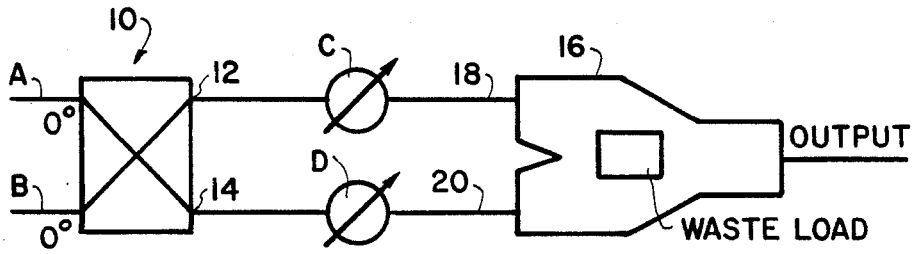
PRIOR ART FIG.1
FIG. 1 is a block diagram of a broadcasting system already known in the art for switching signals from first and second sources to a load or to an antenna; this figure includes a table showing the relationship between input powers from the sources A and B and the output powers, and also indicating the phase shifts provided by the several-phase shifting means.

Before proceeding with a detailed description, it is considered well to review the context of the present invention and the novel principle thereof so that a complete understanding may be gained of the ramifications involved. As has been indicated, the effective phase delay for the first or bottom leg of the known combiner or switcher illustrated in FIG. 1 corresponds with the difference between the individual phase shifts of the phase shifters designated C and D in FIG. 1. However, this arrangement, involving only the different input power ratios, is not effective for the serious problem already described.

Reference to the tabulation labelled Table I herewith will make evident the selective variation of phase delay for a full range of input power ratios in accordance with the present invention. That is to say, the discrete selection of the phase delay to the precise value required as the input powers from the sources vary.

TABLE I

| A | B | TOP LEG | | BOTTOM LEG | | BOTTOM OUTPUT | | |
|---|---|---|---|---|---|---|---|---|
| MAG | MAG | MAG | PHASE | MAG | PHASE | PHASE DELAY | MAG (A + B) | (NORMAL) EFF % |
| 100.0 | 100.0 | 100.0 | 315.00 | 100.0 | 315.00 | 0.00 | 200.0 | 100.0 |
| 99.0 | 100.0 | 99.5 | 314.86 | 99.5 | 315.14 | −0.29 | 199.0 | 100.0 |
| 98.0 | 100.0 | 99.0 | 314.71 | 99.0 | 315.29 | −0.58 | 198.0 | 100.0 |
| 97.0 | 100.0 | 98.5 | 314.56 | 98.5 | 315.44 | −0.87 | 197.0 | 100.0 |
| 96.0 | 100.0 | 98.0 | 314.42 | 98.0 | 315.58 | −1.17 | 196.0 | 100.0 |
| 95.0 | 100.0 | 97.5 | 314.27 | 97.5 | 315.73 | −1.47 | 195.0 | 100.0 |
| 94.0 | 100.0 | 97.0 | 314.11 | 97.0 | 315.89 | −1.77 | 194.0 | 100.0 |
| 93.0 | 100.0 | 96.5 | 313.96 | 96.5 | 316.04 | −2.08 | 193.0 | 100.0 |
| 92.0 | 100.0 | 96.0 | 313.81 | 96.0 | 316.19 | −2.39 | 192.0 | 100.0 |
| 91.0 | 100.0 | 95.5 | 313.65 | 95.5 | 316.35 | −2.70 | 191.0 | 100.0 |
| 90.0 | 100.0 | 95.0 | 313.49 | 95.0 | 316.51 | −3.02 | 190.0 | 100.0 |

TABLE I-continued

| A MAG | B MAG | TOP LEG MAG | TOP LEG PHASE | BOTTOM LEG MAG | BOTTOM LEG PHASE | BOTTOM OUTPUT PHASE DELAY | BOTTOM OUTPUT MAG (A + B) | (NORMAL) EFF % |
|---|---|---|---|---|---|---|---|---|
| 89.0 | 100.0 | 94.5 | 313.33 | 94.5 | 316.67 | −3.34 | 189.0 | 100.0 |
| 88.0 | 100.0 | 94.0 | 313.17 | 94.0 | 316.83 | −3.66 | 188.0 | 100.0 |
| 87.0 | 100.0 | 93.5 | 313.01 | 93.5 | 316.99 | −3.99 | 187.0 | 100.0 |
| 86.0 | 100.0 | 93.0 | 312.84 | 93.0 | 317.16 | −4.32 | 186.0 | 100.0 |
| 85.0 | 100.0 | 92.5 | 312.67 | 92.5 | 317.33 | −4.65 | 185.0 | 100.0 |
| 84.0 | 100.0 | 92.0 | 312.51 | 92.0 | 317.49 | −4.99 | 184.0 | 100.0 |
| 83.0 | 100.0 | 91.5 | 312.33 | 91.5 | 317.67 | −5.33 | 183.0 | 100.0 |
| 82.0 | 100.0 | 91.0 | 312.16 | 91.0 | 317.84 | −5.68 | 182.0 | 100.0 |
| 81.0 | 100.0 | 90.5 | 311.99 | 90.5 | 319.01 | −6.03 | 181.0 | 100.0 |
| 80.0 | 100.0 | 90.0 | 311.81 | 90.0 | 318.19 | −6.38 | 180.0 | 100.0 |
| 79.0 | 100.0 | 89.5 | 311.63 | 89.5 | 318.37 | −6.74 | 179.0 | 100.0 |
| 78.0 | 100.0 | 89.0 | 311.45 | 89.0 | 318.55 | −7.10 | 178.0 | 100.0 |
| 77.0 | 100.0 | 88.5 | 311.27 | 88.5 | 318.73 | −7.47 | 177.0 | 100.0 |
| 76.0 | 100.0 | 88.0 | 311.08 | 88.0 | 318.92 | −7.84 | 176.0 | 100.0 |
| 75.0 | 100.0 | 87.5 | 310.89 | 87.5 | 319.11 | −8.21 | 175.0 | 100.0 |
| 74.0 | 100.0 | 87.0 | 310.70 | 87.0 | 319.30 | −8.59 | 174.0 | 100.0 |
| 73.0 | 100.0 | 86.5 | 310.51 | 86.5 | 319.49 | −8.98 | 173.0 | 100.0 |
| 72.0 | 100.0 | 86.0 | 310.32 | 86.0 | 319.68 | −9.37 | 172.0 | 100.0 |
| 71.0 | 100.0 | 85.5 | 310.12 | 85.5 | 319.88 | −9.76 | 171.0 | 100.0 |
| 70.0 | 100.0 | 85.0 | 309.92 | 85.0 | 320.08 | −10.16 | 170.0 | 100.0 |
| 69.0 | 100.0 | 84.5 | 309.72 | 84.5 | 320.28 | −10.57 | 169.0 | 100.0 |
| 68.0 | 100.0 | 84.0 | 309.51 | 84.0 | 320.49 | −10.98 | 168.0 | 100.0 |
| 67.0 | 100.0 | 83.5 | 309.30 | 83.5 | 320.70 | −11.40 | 167.0 | 100.0 |
| 66.0 | 100.0 | 83.0 | 309.09 | 83.0 | 320.91 | −11.82 | 166.0 | 100.0 |
| 65.0 | 100.0 | 82.5 | 308.88 | 82.5 | 321.12 | −12.25 | 165.0 | 100.0 |
| 64.0 | 100.0 | 82.0 | 308.66 | 82.0 | 321.34 | −12.68 | 164.0 | 100.0 |
| 63.0 | 100.0 | 81.5 | 308.44 | 81.5 | 321.56 | −13.12 | 163.0 | 100.0 |
| 62.0 | 100.0 | 81.0 | 308.22 | 81.0 | 321.78 | −13.57 | 162.0 | 100.0 |
| 61.0 | 100.0 | 80.5 | 307.99 | 80.5 | 322.01 | −14.02 | 161.0 | 100.0 |
| 60.0 | 100.0 | 80.8 | 307.76 | 80.5 | 322.24 | −14.48 | 160.0 | 100.0 |
| 59.0 | 100.0 | 79.5 | 307.53 | 79.5 | 322.47 | −14.94 | 159.0 | 100.0 |
| 58.0 | 100.0 | 79.0 | 307.29 | 79.0 | 322.71 | −15.42 | 158.0 | 100.0 |
| 57.0 | 100.0 | 78.5 | 307.05 | 78.5 | 322.95 | −15.90 | 157.0 | 100.0 |
| 56.0 | 100.0 | 78.0 | 306.81 | 78.0 | 323.19 | −16.38 | 156.0 | 100.0 |
| 55.0 | 100.0 | 77.5 | 306.56 | 77.5 | 323.44 | −16.88 | 155.0 | 100.0 |
| 54.0 | 100.0 | 77.0 | 306.31 | 77.0 | 323.69 | −17.38 | 154.0 | 100.0 |
| 53.0 | 100.0 | 76.5 | 306.06 | 76.5 | 323.94 | −17.89 | 153.0 | 100.0 |
| 52.0 | 100.0 | 76.0 | 305.80 | 76.0 | 324.20 | −18.41 | 152.0 | 100.0 |
| 51.0 | 100.0 | 75.5 | 305.53 | 75.5 | 324.47 | −18.94 | 151.0 | 100.0 |
| 50.0 | 100.0 | 75.0 | 305.26 | 75.0 | 324.74 | −19.47 | 150.0 | 100.0 |
| 49.0 | 100.0 | 74.5 | 304.99 | 74.5 | 325.01 | −20.02 | 149.0 | 100.0 |
| 48.0 | 100.0 | 74.0 | 304.72 | 74.0 | 325.28 | −20.57 | 148.0 | 100.0 |
| 47.0 | 100.0 | 73.5 | 304.43 | 73.5 | 325.57 | −21.13 | 147.0 | 100.0 |
| 46.0 | 100.0 | 73.0 | 304.15 | 73.0 | 325.85 | −21.71 | 146.0 | 100.0 |
| 45.0 | 100.0 | 72.5 | 303.85 | 72.5 | 326.15 | −22.29 | 145.0 | 100.0 |
| 44.0 | 100.0 | 72.0 | 303.56 | 72.0 | 326.44 | −22.89 | 144.0 | 100.0 |
| 43.0 | 100.0 | 71.5 | 303.25 | 71.5 | 326.75 | −23.49 | 143.0 | 100.0 |
| 42.0 | 100.0 | 71.0 | 302.95 | 71.0 | 327.05 | −24.11 | 142.0 | 100.0 |
| 41.0 | 100.0 | 70.5 | 302.63 | 70.5 | 327.37 | −24.74 | 141.0 | 100.0 |
| 40.0 | 100.0 | 70.0 | 302.31 | 70.0 | 327.69 | −25.38 | 140.0 | 100.0 |
| 39.0 | 100.0 | 69.5 | 301.98 | 69.5 | 328.02 | −26.03 | 139.0 | 100.0 |
| 38.0 | 100.0 | 69.0 | 301.65 | 69.0 | 328.35 | −26.70 | 138.0 | 100.0 |
| 37.0 | 100.0 | 68.5 | 301.31 | 68.5 | 328.69 | −27.38 | 137.0 | 100.0 |
| 36.0 | 100.0 | 68.0 | 300.96 | 68.0 | 329.04 | −28.07 | 136.0 | 100.0 |
| 35.0 | 100.0 | 67.5 | 329.39 | 67.5 | 329.39 | −28.78 | 135.0 | 100.0 |
| 34.0 | 100.0 | 67.0 | 300.25 | 67.0 | 329.75 | −29.51 | 134.0 | 100.0 |
| 33.0 | 100.0 | 66.5 | 299.88 | 66.5 | 330.12 | −30.25 | 133.0 | 100.0 |
| 32.0 | 100.0 | 66.0 | 299.50 | 66.0 | 330.50 | −31.01 | 132.0 | 100.0 |
| 31.0 | 100.0 | 65.5 | 299.11 | 65.5 | 330.89 | −31.78 | 131.0 | 100.0 |
| 30.0 | 100.0 | 65.0 | 298.71 | 65.0 | 331.29 | −32.58 | 130.0 | 100.0 |
| 29.0 | 100.0 | 64.5 | 298.30 | 64.5 | 331.70 | −33.39 | 129.0 | 100.0 |
| 28.0 | 100.0 | 64.0 | 297.89 | 64.0 | 332.11 | −34.23 | 128.0 | 100.0 |
| 27.0 | 100.0 | 63.5 | 297.46 | 63.5 | 332.54 | −35.09 | 127.0 | 100.0 |
| 26.0 | 100.0 | 63.0 | 297.02 | 63.0 | 332.98 | −35.97 | 126.0 | 100.0 |
| 25.0 | 100.0 | 62.5 | 296.57 | 62.5 | 333.43 | −36.87 | 125.0 | 100.0 |
| 24.0 | 100.0 | 62.0 | 296.10 | 62.0 | 333.90 | −37.80 | 124.0 | 100.0 |
| 23.0 | 100.0 | 61.5 | 295.62 | 61.5 | 334.38 | −38.76 | 123.0 | 100.0 |
| 22.0 | 100.0 | 61.0 | 295.13 | 61.0 | 334.87 | −39.74 | 122.0 | 100.0 |
| 21.0 | 100.0 | 60.5 | 294.62 | 60.5 | 335.38 | −40.76 | 121.0 | 100.0 |
| 20.0 | 100.0 | 60.0 | 294.09 | 60.0 | 335.91 | −41.81 | 120.0 | 100.0 |
| 19.0 | 100.0 | 59.5 | 293.55 | 59.5 | 336.45 | −42.90 | 119.0 | 100.0 |
| 18.0 | 100.0 | 59.0 | 292.99 | 59.0 | 337.01 | −44.02 | 118.0 | 100.0 |
| 17.0 | 100.0 | 58.5 | 292.41 | 58.5 | 337.59 | −45.19 | 117.0 | 100.0 |
| 16.0 | 100.0 | 58.0 | 291.80 | 58.0 | 338.20 | −46.40 | 116.0 | 100.0 |
| 15.0 | 100.0 | 57.5 | 291.17 | 57.5 | 338.83 | −47.66 | 115.0 | 100.0 |
| 14.0 | 100.0 | 57.0 | 290.51 | 57.0 | 339.49 | −48.97 | 114.0 | 100.0 |
| 13.0 | 100.0 | 56.5 | 289.83 | 56.5 | 340.17 | −50.35 | 113.0 | 100.0 |
| 12.0 | 100.0 | 56.0 | 289.11 | 56.0 | 340.89 | −51.79 | 112.0 | 100.0 |

TABLE I-continued

| A MAG | B MAG | TOP LEG MAG | TOP LEG PHASE | BOTTOM LEG MAG | BOTTOM LEG PHASE | BOTTOM OUTPUT PHASE DELAY | BOTTOM OUTPUT MAG (A + B) | (NORMAL) EFF % |
|---|---|---|---|---|---|---|---|---|
| 11.0 | 100.0 | 55.5 | 288.35 | 55.5 | 341.65 | −53.30 | 111.0 | 100.0 |
| 10.0 | 100.0 | 55.0 | 287.55 | 55.0 | 342.45 | −54.90 | 110.0 | 100.0 |
| 9.0 | 100.0 | 54.5 | 286.70 | 54.5 | 343.30 | −56.60 | 109.0 | 100.0 |
| 8.0 | 100.0 | 54.0 | 285.79 | 54.0 | 344.21 | −58.41 | 108.0 | 100.0 |
| 7.0 | 100.0 | 53.5 | 284.82 | 53.5 | 345.18 | −60.36 | 107.0 | 100.0 |
| 6.0 | 100.0 | 53.0 | 283.76 | 53.0 | 346.24 | −62.47 | 106.0 | 100.0 |
| 5.0 | 100.0 | 52.5 | 282.60 | 52.5 | 347.40 | −64.79 | 105.0 | 100.0 |
| 4.0 | 100.0 | 52.0 | 281.31 | 52.0 | 348.69 | −67.38 | 104.0 | 100.0 |
| 3.0 | 100.0 | 51.5 | 279.83 | 51.5 | 350.17 | −70.35 | 103.0 | 100.0 |
| 2.0 | 100.0 | 51.0 | 278.05 | 51.0 | 351.95 | −73.90 | 102.0 | 100.0 |
| 1.0 | 100.0 | 50.5 | 275.7 | 50.5 | 354.29 | −78.58 | 101.00 | 100.0 |
| 0.0 | 100.0 | 50.0 | 270.0 | 50.0 | 360.00 | −90.00 | 100.00 | 100.0 |

Table I gives a listing of the source signals (for the sake of convenience, the source signals at the input ports to the first coupler of what is designated the first switcher are designated A Mag and B Mag). Further, the "top leg" output signal from one of the output ports is designated with magnitude and phase, and likewise the "bottom leg" signal. The phase delay between the individual phase shifters, for example, those designated 100 and 102, (see FIG. 2) is indicated in the seventh column to the right in the table. The output (normal) is also listed in the table in the eighth column to the right, it being understood that the magnitude of the output as shown is the sum of A and B. Thus, for example, in the case where the A input magnitude is 100 and the B magnitude is 100, the sum will be as listed, namely 200. It is to be noted that the phase of the signals at either input A or B is zero degrees.

Figure 2:
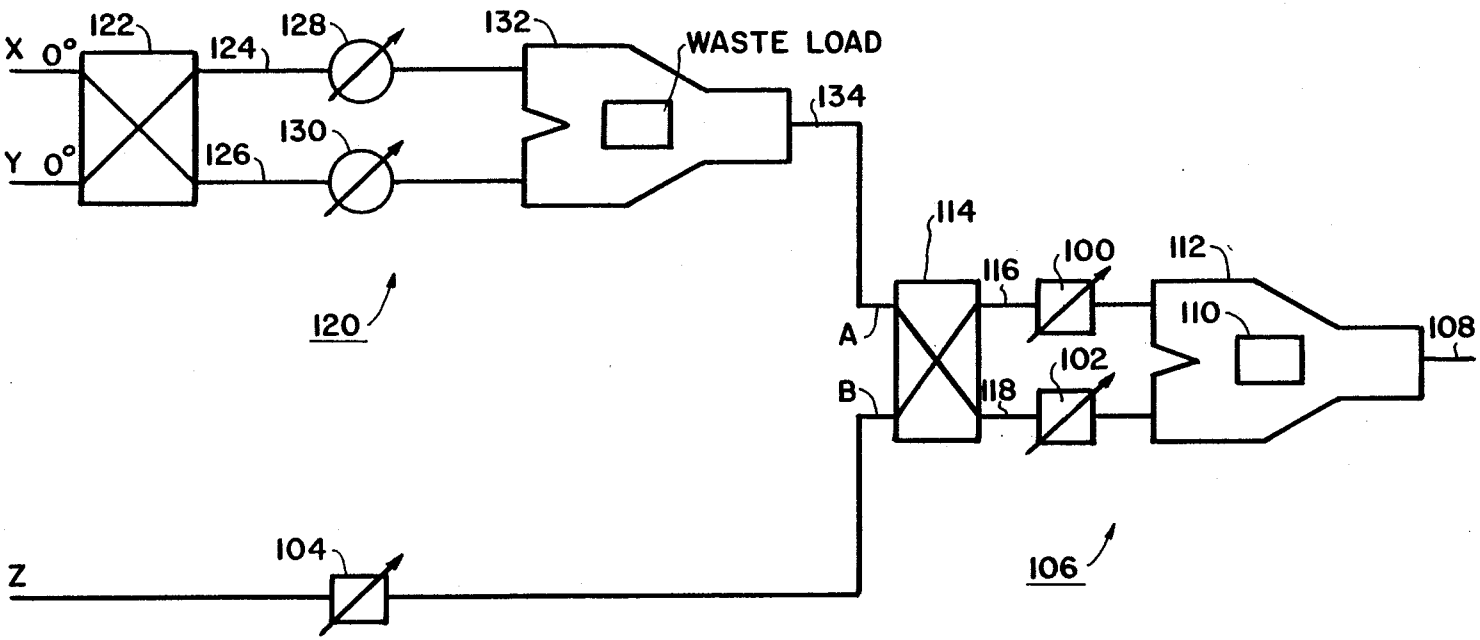
FIG. 2 is a block diagram of a broadcasting system according to the invention for switching signals from at least first and second sources to a load or to an antenna, and further illustrates two switcher or combiner units configured to enable the combining and switching of three identical sources such as transmitters A, B, and C.

Referring now to FIG. 2, the normal output from what may be designated the first switcher 106 is designated 108. It will be understood that the waste load output is 110. The Magic Tee coupler (3dB, 0 degrees) is designated 112. The other coupler (3dB, 90 degrees) is designated 114; that is, the coupler whose output ports are connected to the special phase shifters 100 and 102 respectively.

The special phase shifters 100 and 102 are able to be selectively varied so that there can be discrete selection of the phase in each of the respective legs 116 and 118 over a full range of phase values, thereby to provide a phase delay between the individual phase shifting means 100 and 102 such that any output power corresponding to combinations of input powers can be achieved at the normal and waste loads 108, 110 for a full range of input power ratios.

This can be verified by a thoroughgoing analysis of the Table I already presented. For example, in the case of an A signal present at one of the input ports of coupler 114, and the B signal present at the other input port, and assuming that A has a value of 50 and B a value of 100, then the effect of the inventive feature of the present invention is that the phase shifting means 100 is selected to have a phase shift of 305.26 degrees, whereas the phase shifting means 102 is selected to have a phase shift of 324.74 degrees, the phase delay being the difference between these two values. The magnitude of each of the signals in the respective legs 116 and 118 is 75 as indicated in Table I.

The important point to note is that the normal output is the sum of A and B or 150 as also indicated in Table I. Thus, by suitable interconnection of conventional couplers but with specially arranged phase shifting, the appropriate output power is the sum of unequal input powers (1:2 ratio), and is realized at an efficiency of 100%.

As will be seen in FIG. 2, the principle already explained in connection with first switcher 106 is extended to the problem of connecting three transmitters or sources X, Y, and Z, such sources typically having equal power, so as to produce at the final normal output 108 a variety of output powers corresponding to combinations of varying input powers. That is to say, at the normal output 108 there will be produced either X alone, Y alone, or Z alone, or the sum of any two of them, or the sum of all three.

Likewise, the same results can be brought about at the waste load output. Thus, as indicated previously, it is only necessary to make each phase delay listed in Table I greater by 180 degrees to select a waste load output of X alone, Y alone, Z alone, or the sum of any two, or the sum of all three.

The power may be diverted to waste load 110 by producing a 180 degree difference in the phase between legs 116 and 118 by delaying the phase in phase shifters 100 or 102 and choosing the one with the smaller phase lag requirement to produce the desired result.

It will be seen in FIG. 2 that the second switcher 120 comprises a coupler 122 (3dB, 90 degrees), top leg 124, bottom leg 126; as well as the more conventional phase shifters 128 in the top leg and 130 in the bottom leg; and the Magic Tee coupler 132 (3dB, 0 degrees). It will be appreciated that at the output 134 of the Magic Tee coupler 132 there is produced the X input alone, Y alone, or the sum of X and Y.

It will also be understood that because the example under consideration involves X, Y, and Z sources of equal power, what this means is that the phase shifters 128 and 130 can be of the more conventional type, that is to say, those previously illustrated in FIG. 1 wherein only a limited number of phase delays are necessary such as 0, −90, and −180 as shown in the table under FIG. 1. However, if the sources X and Y had unequal powers, suitable substitution could be made of the special phase shifting arrangements such as 100 and 102. It will be seen that an additional special phase shifter, 104 is included in order to provide suitable phase shifting for the additional Z source of power.

Figure 3A:
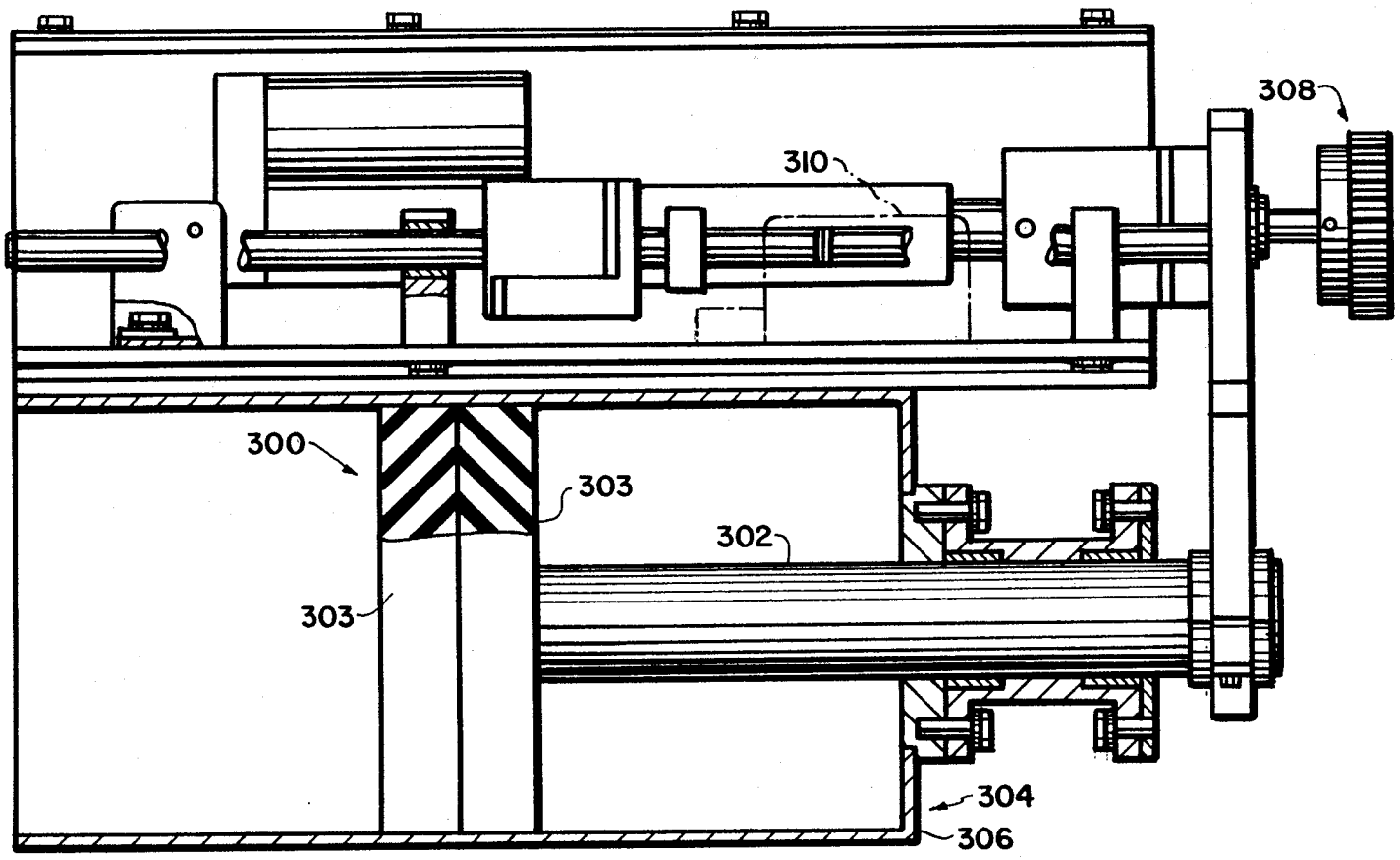
FIGS. 3A and 3B are elevational and perspective views respectively of the special phase shifting means incorporated in the system of FIG. 2.
Figure 3B:
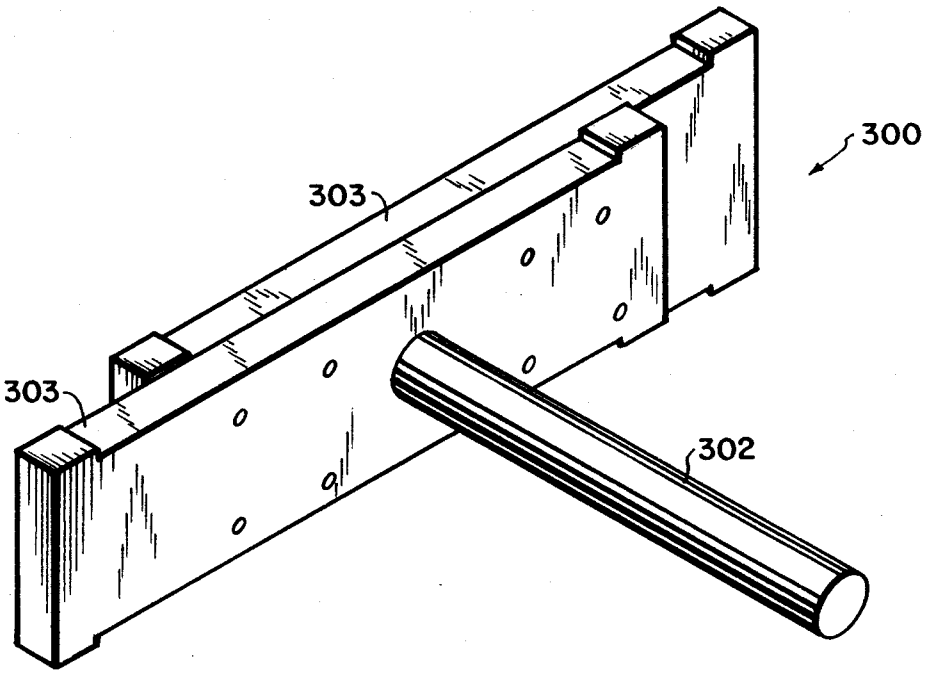

Reference to FIGS. 3A and 3B will make clear that the special phase shifter, such as 100, is designed and constructed as shown schematically in that figure, such that a whole variety of phase angles can be selected. Thus, the phase delay is produced by virtue of a large piece of dielectric material, 300 typically Teflon, which is placed in the waveguide 304. The size of the dielectric is chosen to produce a reference delay when located near the outside edge 306 of the waveguide and a delay of 90 degrees greater than the reference as the dielectric is moved to the center of the waveguide. The piece 300 comprises a rod 302 and a pair of elements 303 bolted together and attached to the rod.

The dielectric piece 300 must be movable by suitable means 308, either manually and electrically actuatable, from the reference position to the −90 degree position, as well as any intermediate position determined by the customer requirement and consideration of the desired resulting phase as listed in Table I. The several selected positions are determined by reason of stops which are provided, such as stop 310, seen in phantom in FIG. 3A. The 180 degree delay mentioned hereinabove is not usually required by the broadcaster's application.

Figure 4:
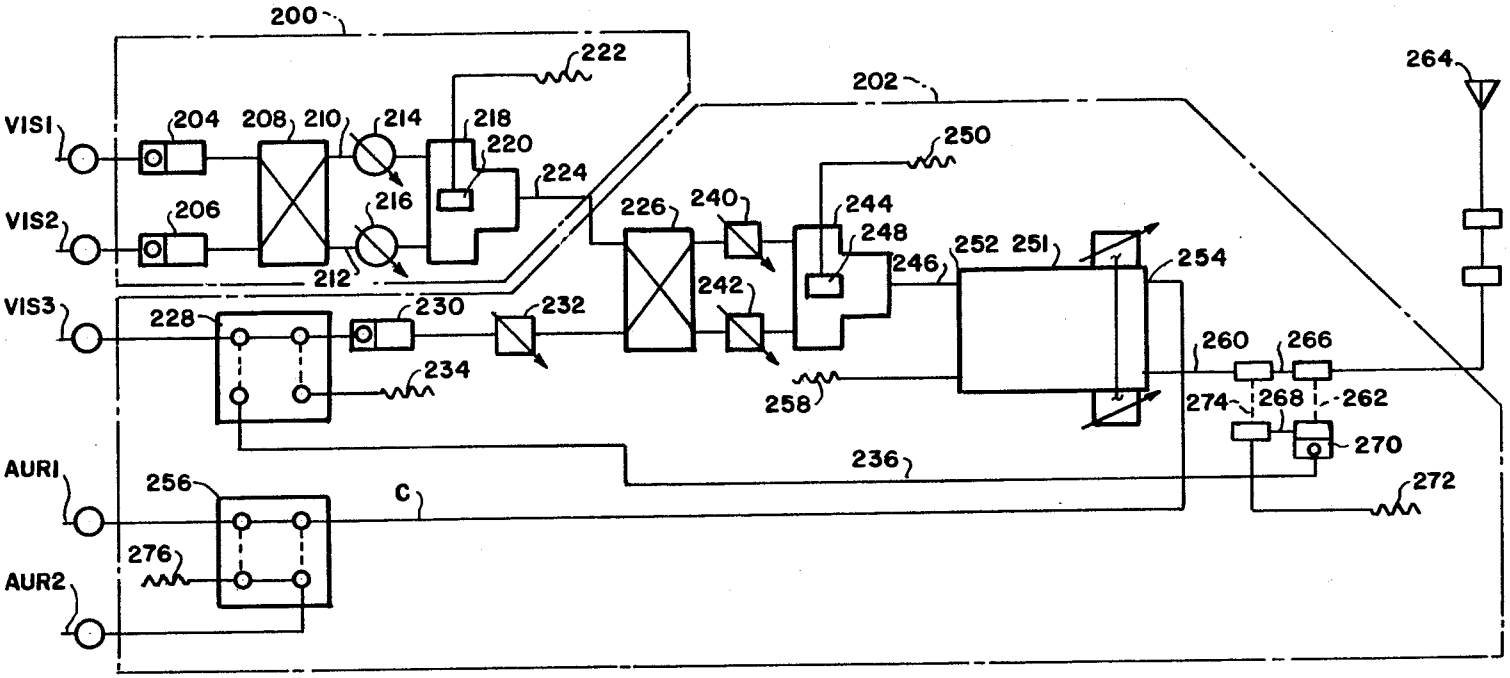
FIG. 4 is a schematic diagram illustrating an application of the principle illustrated in FIG. 2 specifically applied to, and involving, three visual sources; in addition, two aural sources are provided to form a diplex system, per se well known in the art.

Referring now to FIG. 4, there is shown a more elaborate or complex diplexer system which incorporates the salient features of the present invention and hence is substantially the same in principle as what has already been illustrated in FIGS. 2 and 3.

It will be noted first of all that there are three visual sources, designated VIS1, VIS2, and VIS3, suitably connected at the upper left portion of the schematic diagram. The symbol C in each of the input paths indicates that a coaxial input line is provided. The aural input sources are designated AUR1 and AUR2, the latter simply being an alternate source that may be suitably switched into the circuit. As with the visual sources, the aural sources are connected by coaxial means designated C.

For convenience, and in view of the fact that the waveguide equipment involved is of substantial size, the schematic indicates that there are two separate frames, labelled 200 and 202, both shown by broken lines, the first two visual input sources VIS1 and VIS2 being disposed on frame 200, whereas VIS3, AUR1, and AUR2 are disposed on frame 202. A typical transition means 204 and 206 enables connection from the coaxial input to the waveguide equipment. From the individual waveguide end of the means 204 and 206, connections are made to the two input ports of hybrid coupler 208.

Connections are made from the output ports of coupler 208 in conventional fashion via legs 210 and 212 to the respective phase shifters 214 and 216; from the output thereof, connection is made to the input ports of magic tee coupler 218. Waste load port 220 is connected as before to a waste load 222. A normal output 224 is provided and suitably connected to one of the input ports of another conventional hybrid coupler 226.

It will be understood from the preceding description that the hybrid couplers mentioned are typically 3dB, 90 degree couplers per se well-known in the art.

The other input port of coupler 226 is coupled to the third visual source, that is, VIS3, by way of a coaxial switch 228, a further transition means 230 to convert from coaxial to waveguide, and a further phase shifter 232 connected between the transition means 230 and the other input port of coupler 226.

It will be appreciated that for the coaxial switch 228, there are two pairs of switch paths represented respectively by the solid lines and by the dotted lines. In other words, these represent two alternate positions for the switch. Thus, for the coaxial switch 228, the VIS3 source is in the first position of the switch connected to the transition means 230; also the waste load 234 is connected to the VIS3 emergency bypass line 236. In the dotted alternate position, the VIS3 source is connected to the emergency bypass line 236 and the transition means 230 is connected to the waste load 234.

The output ports of hybrid coupler 226 are connected by way of the respective special phase shifters 240 and 242 to the input ports of a magic tee coupler 244. In the manner already described, outputs in the form of a normal output 246 and a waste load output 248 are taken from the magic tee coupler. The waste load port is connected to waste load 250, whereas the normal output 246 is connected to an input port of a means 251 for combining the visual sources with the aural sources. The visual sources are normally combined at the input port 252. Another input port 254 is provided for the reception of the alternate output from either the AUR1 source or the AUR2 source. The sourcing is alternate because a suitable coaxial switch 256 is provided with the pairs of switch paths in solid lines or dotted lines, as already explained in connection with switch 228.

The diplexing and combining of both types of sources in the means 251 is a standard technique and suitable outputs in the form of an output 256 extends to a waste load 258, whereas an output 260 is suitably connected to a waveguide switch 262, having solid and dotted line positions as indicated.

By this switch means 262 the VIS3 emergency bypass coaxial bypass line VIS3 can be alternately connected to an antenna 264. The antenna can also be alternately connected by the solid line 266 of the switch 262. At the same time, the other solid line 268 connects the transition means 270 to waste load 272 The other dotted line 274 enables coupling output 260 to waste load 272.

As noted previously, the AUR1 and AUR2 sources are alternately connected, this being done by having the AUR2 source connected by the solid line of the switch to the waste load 276 when the AUR1 source is connected to the input port 254 of the diplexer means 251; whereas the reverse obtains when switch 256 is at its dotted line position.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A switcher of high-power, high-frequency signals from at lest first and second sources, each having an input power value, respectively to a plurality of loads so as to provide a switchless switching operation, said switcher comprising:

a first hybrid coupler, having input and output ports, the input ports being connected to the respective sources, the output ports of said coupler being connected to top and bottom legs defining respective conductive paths;

respective phase shifting means connected in each leg;

a second hybrid coupler, having input and output ports, its input ports being connected to said top and bottom legs respectively;

a normal output load and a waste output load to which the respective output ports of said second hybrid coupler are connected;

means for discretely selecting, in accordance with an input power value of the first and second sources, the phase value of each of said phase shifting means in the respective legs over a full range of phase values to provide a phase delay between such phase shifting means such that any output power corresponding to any combination of input powers from said first and second sources can be achieved at the normal and waste loads for a full range of input power ratios.

2. A switcher as defined in claim 1, in which said range of phase values is from 315 degrees to 360 degrees.

3. A switcher as defined in claim 1, in which the input power ratio is 2, said phase delay between said phase shifting means being selected to be −19.47 degrees.

4. A switcher as defined in claim 1, in which said full range of input power ratios is from 100:100 to 100:0.

5. A switcher as defined in claim 1, the second coupler of which is a magic tee.

6. The combination of first and second switchers of high-power, high-frequency signals from at least first, second, and third sources, each having an input power value, to a plurality of loads so as to provide a switchless switching operation, said combination comprising:

(1) a first switcher including:

(a) a first hybrid coupler having input and output ports, the input ports being connected respectively to a resultant source, resulting from the coupling of said first and second sources, and to said third source, the output ports of said coupler being connected to top and bottom legs defining respective conductive paths;

(b) a respective phase shifting means connected in each leg;

(c) a second hybrid coupler having input and output ports, its input ports being connected to said top and bottom legs respectively;

(d) a normal output load and a waste output load to which the respective output ports of said second hybrid coupler are connected;

(e) means for discretely selecting, in accordance with an input power ratio of said resultant source and said third source, the phase of each of said phase shifting means in the respective legs over an entire range of phase values with a phase delay between such phase shifting means such that any output power corresponding to any combination of input powers from said first and second sources can be achieved at the normal and waste loads for a full range of input power ratios.

(2) a second switcher including:

(a) a third hybrid coupler, having input and output ports, and means for connecting said first and second of said sources to the input ports of said third hybrid coupler, the outputs of said third coupler being connected to top and bottom legs defining respective conductive paths;

(b) a respective phase shifting means connected in each leg;

(c) a fourth hybrid coupler having input and output ports, its input ports being connected to said top and bottom legs respectively;

(d) a normal output load and a waste output load to which the output ports of said fourth hybrid coupler are respectively connected;

(e) means for connecting the normal output load of said second switcher, comprising said resultant source, to one of the input ports of said first hybrid coupler of said first switcher.

7. The combination as defined in claim 6, in which said second and fourth couplers are magic tees.

8. The combination as defined in claim 6, in which each of the three sources has the same power.

9. The combination as defined in claim 6, in which the range of phase values of said first switcher is from 315 degrees to 360 degrees.

10. The combination as defined in claim 6, in which the input power ratio is 2, said phase delay between said phase shifting means being selected to be −19.47 degrees.

11. The combination as defined in claim 6, in which said full range of input power ratios is from 100:100 to 100:0.

* * * * *